US005380632A

United States Patent [19]

Marsden et al.

[11] Patent Number: 5,380,632

[45] Date of Patent: Jan. 10, 1995

[54] PHOTOSENSITIVE PHOTOGRAPHIC SILVER HALIDE COLOR MATERIALS

[75] Inventors: Peter D. Marsden, North Harrow; John K. C. Kempster, Stanmore; John A. Bee, Watford, all of United Kingdom

[73] Assignee: Eastman Kodak Company, Rochester, N.Y.

[21] Appl. No.: 30,358

[22] PCT Filed: Aug. 3, 1992

[86] PCT No.: PCT/EP92/01755

§ 371 Date: Mar. 19, 1993

§ 102(e) Date: Mar. 19, 1993

[87] PCT Pub. No.: WO93/03418

PCT Pub. Date: Feb. 18, 1993

[30] Foreign Application Priority Data

Aug. 6, 1991 [GB] United Kingdom ..... 9116930

[51] Int. Cl.[6] ..... G03C 1/46; G03C 1/76

[52] U.S. Cl. ..... 430/505; 430/539; 430/551; 430/642

[58] Field of Search ..... 430/505, 539, 551, 642, 430/523

[56] References Cited

U.S. PATENT DOCUMENTS

| | | | |
|---|---|---|---|
| 4,414,305 | 11/1983 | Nakamura et al. | 430/461 |
| 4,774,168 | 9/1988 | Ogawa et al. | 430/505 |
| 4,954,425 | 4/1990 | Iwano | 430/567 |
| 5,215,875 | 6/1993 | Matejec et al. | 430/505 |

FOREIGN PATENT DOCUMENTS

| | | |
|---|---|---|
| 0447656 | 9/1991 | European Pat. Off. . |
| 2207298 | 6/1974 | France . |
| 3228192 | 2/1983 | Germany . |
| 53-31132 | 3/1978 | Japan . |

OTHER PUBLICATIONS

Patent Abstracts of Japan, vol. 13, No. 40, Jan. 1989 (63 236 034 Abstract).

Patent Abstracts of Japan, vol. 2, No. 65, Mar. 1978 (53 031 132 Abstract).

*Primary Examiner*—Janet C. Baxter

*Attorney, Agent, or Firm*—Paul A. Leipold

[57] ABSTRACT

A photosensitive photographic silver halide colour material comprising at least two dye image-forming units each separated from its neighbouring units by a layer containing a scavenger for oxidised developing agent, each unit comprising at least one silver halide emulsion layer and at least one dye image-forming colour coupler, the material comprising a total silver halide coating weight of less than 300 mg/m$^2$ (as silver) characterised in that at least one image-forming unit contains extra gelatin either in a layer adjacent to the coupler-containing layer or in the coupler-containing layer itself such that the gelatin content of the unit is more than 800 mg/m$^2$, in order to decrease the band width of the dye formed from said coupler.

6 Claims, 2 Drawing Sheets

PHOTOSENSITIVE PHOTOGRAPHIC SILVER HALIDE COLOR MATERIALS

Figure 1:
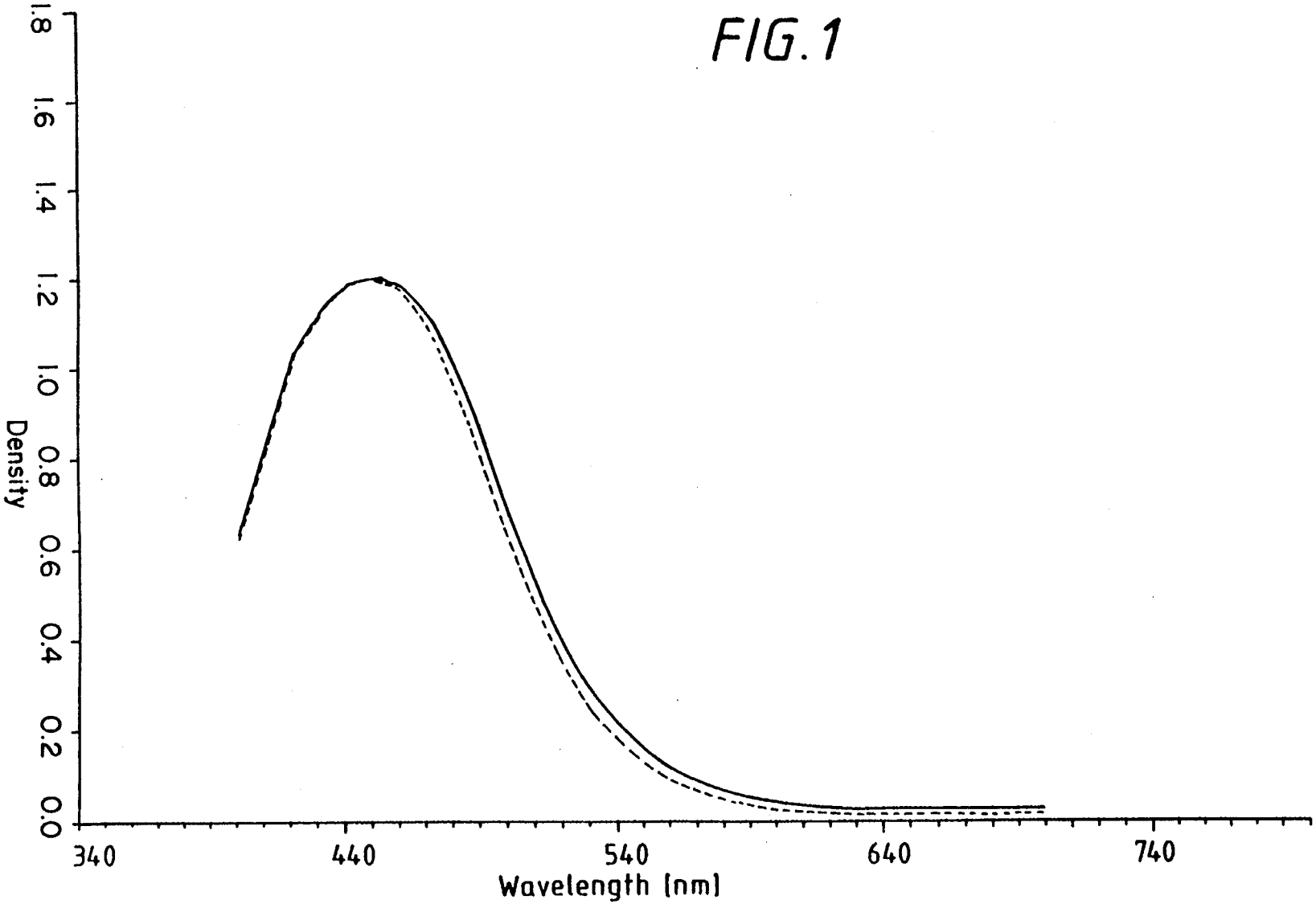

This invention relates to photosensitive photographic silver halide colour materials and in particular to colour print materials.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or developer-amplifier) to form a dye image. The redox amplifying solution contains a reducing agent, for example a colour developing agent, and an oxidising agent which will oxidise the colour developing agent in the presence of the silver image which acts as a catalyst. The photographic material used in such a process may be a conventional coupler-containing silver halide material. Oxidised colour developer reacts with a colour coupler contained in the silver halide emulsion layer to form image dye. The amount of dye formed depends on the time of treatment or the availability of colour coupler rather than the amount of silver in the image as is the case in conventional colour development processes. Hence smaller amounts of silver halide in the photographic material are needed while still providing the desired dye density. Examples of suitable oxidising agents include peroxy compounds including hydrogen peroxide, cobalt (III) complexes including cobalt hexammine complexes, and periodates. Mixtures of such compounds can also be used.

The materials described for processing in this way have had low silver halide coating weights and dye image-forming layers comprising a silver halide emulsion having, incorporated therein, at least one dye image-forming coupler. It has been found that such materials produce dye images which have a less desirable hue compared to similar materials containing a conventional (higher) amount of silver halide which are processed conventionally without redox amplification. Such effects may be observed by studying the spectrophotometric curves of the material or by comparing one of the calculated values of hue, chrome or lightness.

A low-silver material is described, for example, in U.S. Pat. No. 4,954,425 but there is no recognition therein of the above problem or a *fortiori* its solution. In addition the material described does not have a scavenger for oxidised developing agent between the green and red-sensitive layers and will therefore suffer from colour mixing of the magenta and cyan dye images.

The present invention provides photographic colour materials which provide dye images of narrower band width.

According to the present invention there is provided a photosensitive photographic silver halide colour material comprising at least two dye image-forming units each separated from its neighbouring units by a layer containing a scavenger for oxidised developing agent, each unit comprising at least one silver halide emulsion layer and at least one dye image-forming colour coupler, the material comprising a total silver halide coating weight of less than 300 mg/m$^2$ (as silver) characterised in that at least one image-forming unit contains extra gelatin either in a layer adjacent to the coupler-containing layer or in the coupler-containing layer itself such that the gelatin content of the unit is more than 800 mg/m$^2$, in order to decrease the band width of the dye formed from said coupler.

FIG. 1 contains spectrophotometric curves of the comparison of Example 1.

Figure 2:
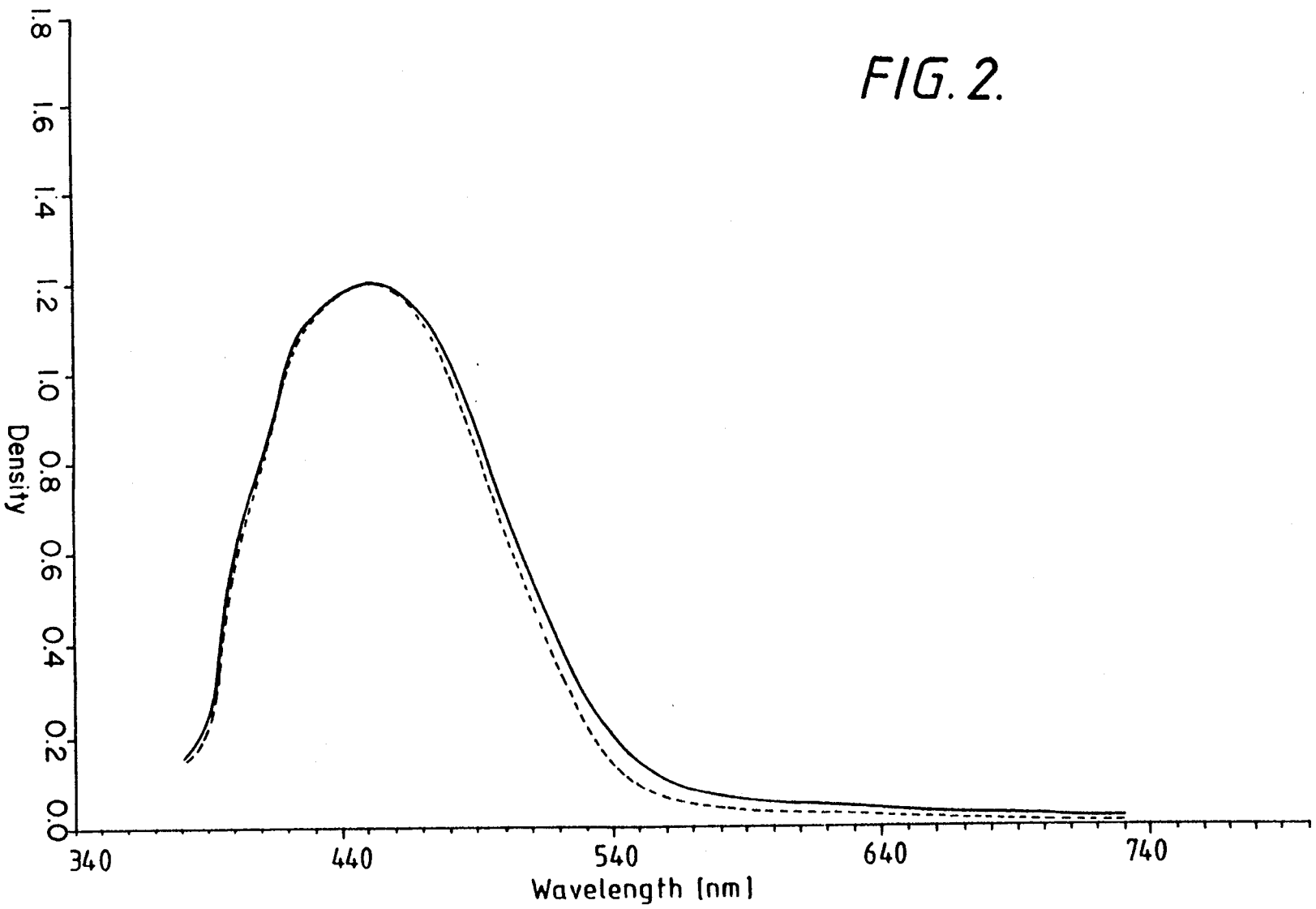

FIG. 2 contains spectrophotometric curves of the comparison of Example 2.

Chroma and, indeed, hue and lightness indices may be calculated by the method of Pointer M. R., (J Phot Sci, 34, 81–90, 1986). It is a consequential advantage of the present invention that the chroma index of the dye image is increased.

It is believed that the additional gelatin allows oxidised colour developer to diffuse laterally thus forming dye at a region slightly removed from the site of the development thus forming a slightly "smeared" dye image. Clearly there should be no scavenger for oxidised developer present in the layer containing the extra gelatin as this would prevent the lateral diffusion of oxidised developing agent. The same effect can be observed whether the silver halide and coupler are coated in separate layers or when the coupler is "diluted" within a single imaging layer.

The amount of gelatin in the separate layer or in the combined emulsion and coupler layer may be optimised by experiment. Preferably a separate gelatin layer contains up to 3000, preferably from 800 to 2000 mg/m$^2$. When the additional gelatin is located in the silver halide emulsion layer, such a layer preferably contains gelatin in an amount of from 800 to 4000, preferably from 1500 to 2000 mg/m$^2$.

The colour photographic material to be processed may be of any type but will preferably contain low amounts of silver halide. Preferred total silver halide coverages are in the range 6 to 300, preferably 10 to 200 mg/m$^2$ and particularly 10 to 100 mg/m$^2$ (as silver). The beneficial effects of the invention are expected to be greater as the coating weight of the silver halide is reduced. The material may comprise the emulsions, sensitisers, couplers, supports, layers, additives, etc. described in Research Disclosure, December 1978, Item 17643, published by Kenneth Mason Publications Ltd, Dudley Annex, 12a North Street, Emsworth, Hants P010 7DQ, U.K.

In a preferred embodiment the photographic material comprises a resin-coated paper support and the emulsion layers comprise more than 80%, preferably more than 90% silver chloride and are more preferably composed of substantially pure silver chloride. Preferably the amplification solution contains hydrogen peroxide and a colour developing agent.

The photographic materials can be single colour materials or multicolour materials. Multicolour materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolour photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filler layers.

The location of the additional gelatin in the image-forming unit may vary but the arrangements below are preferred. In the following diagrams which represent a single image-forming unit comprising a single silver halide layer, Coup means coupler, AgX means silver halide and Gel means the additional gelatin.

| | |
|---|---|
| Gel | AgX + Coup |
| AgX + Coup | Gel |
| Gel + Coup | AgX |
| AgX | Gel + Coup |
| AgX + Coup + Gel | |

The preferred location for a separate gelatin layer is between the support and the blue-sensitive layer. In colour paper materials, the blue-sensitive emulsion layer is preferably coated nearest to the support. Other locations can, however, be contemplated for example adjacent to the green- or red-sensitive layers.

The following Examples are included for a better understanding of the invention.

EXAMPLE 1

Two multilayer colour photographic materials were coated on corona discharge-treated polyethylene coated paper base, Coating 2 (an example of the invention) has a gelatin pad (Layer 1) comprising gelatin at 1076 mg/m$^2$ while Coating 1 (Comparison) has not.

The layers were coated in the order shown and were as follows, the figures indicating laydown in mg/m$^2$ silver halide laydowns as silver:

| | |
|---|---|
| Layer 1 (Invention only) | 1076 |
| Gelatin | |
| Layer 2 | |
| Gelatin | 1500 |
| Blue sensitised cubic grain silver halide emulsion (0.64μ edge length) | 81 |
| Yellow coupler (C) | 1030 |
| Dibutyl phthalate | 281 |
| 2-butoxyethoxyethyl acetate | 281 |
| Layer 3 | |
| Gelatin | 800 |
| Dioctylhydroquinone | 94 |
| Layer 4 | |
| Gelatin | 1200 |
| Green sensitised cubic grain silver halide emulsion (0.33μ edge length) | 43 |
| Magenta coupler (B) | 426 |
| Dibutyl phthalate | 168 |
| 2-butoxyethoxyethyl acetate | 64 |
| Layer 5 | |
| Gelatin | 700 |
| UV absorber | 318 |
| Dioctylhydroquinone | 42 |
| Layer 6 | |
| Gelatin | 1000 |
| Red sensitised cubic grain silver halide emulsion (0.44μ edge length) | 32 |
| Cyan coupler (A) | 415 |
| Dibutyl phthalate | 237 |
| 2-butoxyethoxyethyl acetate | 35 |
| Layer 7 | |
| Gelatin | 700 |
| UV absorber | 318 |
| Dioctylhydroquinone | 42 |
| Layer 8 | |
| Gelatin | 1300 |
| Dioctylhydroquinone | 22 |

Cyan coupler (A) has the formula:

-continued

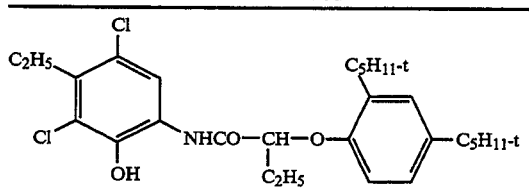

Magenta coupler (B) has the formula:

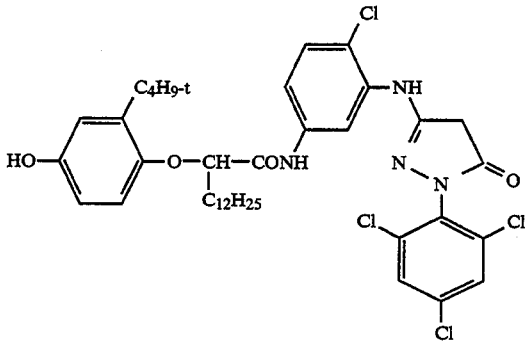

Yellow coupler (C) has the formula:

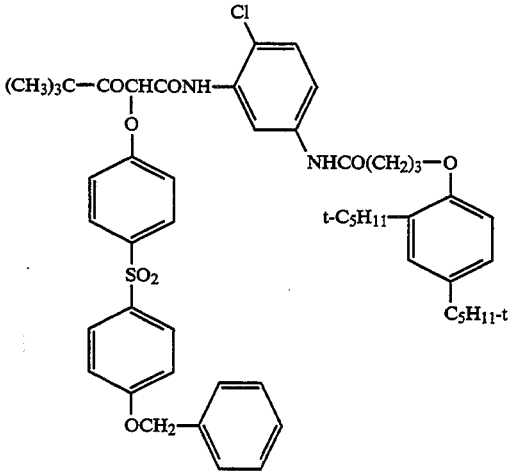

Both coatings were hardened with bis(vinylsulphonyl)methane at 1.8% of the total weight of gelatin.

Both coatings were given stepped exposures through narrow cut red, green and blue filters and processed on an H11 Drum using the solutions and times below:

Develop/amplify (Solution (A)) 45 sec@35° C.
Stop (2% acetic acid) 30 sec
Wash 30 sec
Bleach-fix (Ektacolor RA4) 30 sec
Wash 60 sec

| | | |
|---|---|---|
| Solution (A) | | |
| Sodium sulphite | 1.93 | g |
| 4-N-ethyl-N-(β-methanesulphonamido-ethyl)-o-toluidine sesquisulphate | 5.31 | g |
| Sodium carbonate | 14.5 | g |
| 1-hydroxyethylidene-1,1'-diphosphonic acid | 0.84 | g |
| diethylhydroxylamine | 0.76 | g |
| Potassium chloride | 0.12 | g |
| Potassium bromide | 0.00094 | g |
| Sodium hydroxide | 1.60 | g ) pH |
| 2N Sulphuric acid | 16.8 | ml ) adjust |
| Water to | 1000 | ml |
| pH = 10.1 (at 27° C.) | | |
| Solution (B) | | |

-continued

| | |
|---|---|
| 100 vol hydrogen peroxide (30%) | 400 ml |
| Water to | 1000 ml |

1.29 ml of Solution (B) was added to 97 ml of Solution (A) just before processing. The mixture was poured onto the revolving H11 drum and the exposed strip was processed for 45 sec according to the processing schedule above.

The yellow wedges on the two multilayers were read using a Gretag SPM100 reflection spectrophotometer. The results were used to generate normalised spectrophotometric curves in reflection space, and these are shown in FIG. 1 of the accompanying drawings. As can be seen the multilayer coating containing the gelatin pad produces a better yellow due to a reduced band width. The effect of this hue improvement on the colour index can be calculated using the method of Pointer M. R., (J Phot Sci, 34, 81–90, 1986). For this information the cyan and magenta spectrophotometric curves were also measured and used in the calculations. The colour reproduction index results for the multilayers with and without gelatin pad are shown in Table 1 below. The table shows the change from the reference which is the multilayer coating without the gelatin pad (assumed 100%) however the direction of the change is the important parameter.

TABLE 1

| | Hue | Chroma | Lightness |
|---|---|---|---|
| Red | 99.59 R→Y | 97.96 Inc (2.04) | 99.74 (Lighter) |
| Yellow | 98.93 Y→G (1.07) | 98.15 Inc (1.85) | 99.27 (Lighter) |
| Green | 99.37 G→B (0.63) | 97.19 Inc (2.81) | 99.39 (Lighter) |
| Blue | 99.46 B→R | 99.03 Inc (0.97) | 99.83 (Lighter) |

An overall increase in Chroma for the multilayer of the present invention is observed. Notably Chroma increases in all layers coupled with a 1.07 hue increase in the yellow giving less orange yellows. The differences are fairly small but are in the desired direction.

EXAMPLE 2

Similar multilayer coatings to Example 1 were prepared but at lower total silver laydown (43 mg/m$^2$). The silver laydowns were as follows:

| Layer | (6) Cyan | (4) Magenta | (2) Yellow |
|---|---|---|---|
| Silver mg/m$^2$ | 12 | 14 | 17 |
| Grain Size μm | 0.38 | 0.27 | 0.52 |

The interlayers (3), (5) and (7) were coated at 1.3×the laydowns of Example 1 to further reduce interlayer contamination and increase overall Chroma. Because the silver laydown was reduced, more amplification was necessary to maintain acceptable sensitometry. This was achieved by increasing the amplification time to 60 sec and by increasing the peroxide addition to 2.04 ml of Solution (B) per 97 ml of Solution (A).

Sensitometric measurements on the yellow wedges of the two multilayers shown a band narrowing (illustrated in FIG. 2 of the accompanying drawings) for the coating of the invention with the gel pad (Layer 1). Chroma and hue increases are shown in Table 2 below.

TABLE 2

| | Hue | Chroma | Lightness |
|---|---|---|---|
| Red | 99.69 R→Y (0.31) | 98.52 Inc (1.48) | 99.64 (Lighter) |
| Yellow | 98.65 Y→G (1.35) | 96.76 Inc (3.24) | 98.67 (Lighter)* |
| Green | 99.34 G→B (0.66) | 97.69 Inc (2.31) | 99.47 (Lighter) |
| Blue | 99.48 B→R (0.52) | 99.62 Inc (0.38) | 99.82 (Darker) |

*increase of 1.53

An overall increase in Chroma for the multilayer the invention is observed. Notably increases in the red, yellow and green Chroma coupled with a 1.35 hue improvment in the yellow.

We claim:

1. A photosensitive photographic silver halide colour material comprising at least two dye image-forming units each separated from its neighbouring units by a layer containing a scavenger for oxidised developing agent, each unit comprising at least one silver halide emulsion layer and at least one dye image-forming colour coupler, the material comprising a total silver coating weight of less than 300 mg/m$^2$ characterised in that the material contains a gelatin layer, said gelatin layer is located adjacent a coupler containing silver halide emulsion layer, said gelatin layer is located between the support and said coupler containing silver halide emulsion layer; and said gelatin layer contains from 800 to 3000 mg/m$^2$ of gelatin, in order to decrease the band width of the dye formed from said at least one coupler and said gelatin layer contains no scavenger for oxidised developer.

2. A photographic material as claimed in claim 1 in which said gelatin layer contains from 800 to 2000 mg/m$^2$ of gelatin.

3. A photographic material as claimed in claim 1 in which the silver halide of said coupler containing silver halide emulsion layer comprises at least 80% silver chloride.

4. A photographic material as claimed in claim 1 in which said coupler containing silver halide emulsion layer is blue-sensitive and contains a yellow dye image-forming coupler.

5. A photographic material as claimed in claim 1 in which the total silver coating weight of said material is from 10 to 200 mg/m$^2$.

6. A photographic material as claimed in claim 1 in which the total silver coating weight of said material is from 10 to 100 mg/m$^2$.

* * * * *